United States Patent [19]

Wetzel et al.

[11] Patent Number: 4,543,703

[45] Date of Patent: Oct. 1, 1985

[54] METHOD OF FIELD ASSEMBLY OF A SELECTED NUMBER OF SHAPED CHARGES IN A WELL CASING PERFORATING GUN

[75] Inventors: Rodney J. Wetzel, Woodlands; Gregg W. Stout, Montgomery, both of Tex.

[73] Assignee: Baker Oil Tools, Inc., Orange, Calif.

[21] Appl. No.: 366,267

[22] Filed: Apr. 7, 1982

Related U.S. Application Data

[63] Continuation-in-part of Ser. No. 250,772, Apr. 3, 1981, abandoned.

[51] Int. Cl.[4] ..... B21D 39/00

[52] U.S. Cl. ..... 29/455 R; 29/453; 102/310; 166/51; 175/4.6

[58] Field of Search ..... 29/1.2, 428, 455 R, 29/453; 89/1 C; 102/310, 312, 372; 166/278, 63, 51, 55.7, 55.8; 175/4.52, 4.6

[56] References Cited

U.S. PATENT DOCUMENTS

| | | | |
|---|---|---|---|
| 2,649,046 | 8/1953 | Davis | 102/310 |
| 2,686,472 | 8/1954 | Burns | 175/4.6 |
| 2,873,676 | 2/1959 | Caldwell | 102/310 X |
| 2,916,991 | 12/1959 | Gilbert | 175/4.6 |
| 3,146,710 | 9/1964 | Atwood | 102/310 |
| 3,762,326 | 10/1973 | Edgell et al. | 102/310 |

*Primary Examiner*—Charlie T. Moon

*Attorney, Agent, or Firm*—Norvell & Associates

[57] ABSTRACT

A method and apparatus effecting the perforating of a well casing and the gravel packing of the perforated areas of the well casing of a combined perforating and gravel packing apparatus. This desirable objective is accomplished by a perforating gun construction permitting complete flexiblility to adjust in the field the number of horizontally and veritcally spaced shaped charges through the provision of a polygonal carrier having vertically spaced holes provided in each of its planar sides to accommodate vertically spaced horizontal groups of shaped charges with the charges in one horizontal group being angularly displaced relative to the charges in a vertically adjacent horizontal group. Additionally, the crossover mandrel employed in the gravel packing operation provides, in its run-in position, a continuous axial passage through its entire length, permitting a detonating device to be placed therethrough to actuate the perforating gun. Subsequent to the perforating operation, a ball is dropped and seated on an annular sleeve carried within the hollow mandrel which permits the development of internal pressure within the mandrel. Such internal pressure is employed not only to effect the setting of a fluid pressure actuated packer but also to shift the ball supporting sleeve downwardly and uncover a crossover port in the mandrel which permits the gravel packing operation to be carried out conventionally.

2 Claims, 14 Drawing Figures

METHOD OF FIELD ASSEMBLY OF A SELECTED NUMBER OF SHAPED CHARGES IN A WELL CASING PERFORATING GUN

RELATIONSHIP TO OTHER CO-PENDNG APPLICATIONS

This application constitutes a continuation-in-part of application Ser. No. 250,772, filed Apr. 3, 1981, now abandoned, entitled "One Trip Perforating And Gravel Pack System", and assigned to the assignee of this invention.

BACKGROUND OF THE INVENTION

1. Field of the Invention

This invention relates to a method and apparatus for effecting the perforating and the gravel packing of a production zone in a subterranean well.

2. Description of the Prior Art

As oil and gas wells are drilled to constantly increasing depths, the cost of completion or workover of a well is disproportionally increased by the number of trips of completion apparatus that must be made into the well in order to effect its completion or workover. Necessarily, every encased producing well has to have the casing perforated in the production zone. It is equally necessary in the case of many wells to provide gravel packing in the area of the perforations to filter out sand produced with the production fluids and thus prevent its entry into the well bore and into the production conduit. It has heretofore been necessary to make several trips of a work string into the well in order to first effect the perforation of the well casing and then the gravel packing of one or more production zones surrounding the perforations. Most commonly used tubing conveyed perforating apparatus rely upon percussion firing of explosive charges. Such firing is produced by dropping a weight through the tubular work string to fire a primer carried by the perforating apparatus located at the bottom of the well. It is therefore necessary that the bore of the tubular work string be initially unrestricted, at least to the extent to permit the free passage of the firing weight or bar therethrough.

It has previously been suggested that the gravel packing of a plurality of production zones of a well could be accomplished in a single trip of a specially designed gravel packing apparatus into the well. Such apparatus is, for example, disclosed in U.S. Pat. No. 3,987,854 to Callihan et al. and also in the copending application Ser. No. 170,494, filed July 21, 1980, and assigned to the assignee of the present application. In both instances, however, the crossover tool which forms an essential part of such multiple zone gravel packing apparatus, has not provided an unrestricted axial passage through the crossover apparatus. Therefore, it has been a practical impossibility to enter the well with both a perforating apparatus and a gravel packing apparatus and accomplish both operations in the same trip.

Additionally, since the entire perforating operation is to be performed in the same single trip, it is highly desirable that the perforating gun be capable of adjustment in the field of both the total number and the horizontal and vertical spacings of the shaped charges employed in the perforating operation. An economical apparatus permitting the convenient field assembly of a plurality of shaped charges in any desired vertical and horizontal configuration has not heretofore been available.

SUMMARY OF THE INVENTION

This invention provides an improved apparatus for the completion of subterranean wells which permits the perforation of the casing at a production zone in the well and the subsequent gravel packing of a liner, screen or other filtering means positioned adjacent to the casing perforations with a single trip of the required apparatus into the well, following which the mandrel element of the gravel packing apparatus may be removed from the well, and the work string replaced by production tubing, permitting the well to be placed immediately in production.

To provide any desired number and spacing of shaped charges for effecting the perforation of the well casing and the adjoining formation, this invention provides a tubular housing assembly which is connected by conduit to the bottom end portion of the gravel packing apparatus. Such tubular assembly defines at least one generally cylindrical, vertical axis chamber in which a plurality of shaped charges are mounted. A primer cord in the chamber is energized by a percussion actuated detonator which may be activated by dropping a ball, bar or other device through the gravel packing apparatus. The shaped charges are disposed within the cylindrical chamber by being mounted on the planar sides of a tubular carrier having a polygonal shaped cross-section with an even number of sides and at least six such sides. Vertically spaced apertures are provided in each of the planar sides of the polygonal carrier to effect the mounting of the shaped charges therein. The apertures are arranged to permit the shaped charge containers to be disposed in a plurality of vertically spaced, horizontal groups with the containers of each horizontal group being angularly displaced relative to the containers in the vertically adjacent horizontal group by 360°/N, where N equals the number of sides of the polygonal carrier. The resulting perforations are thus uniformly distributed around the periphery of the well casing and also vertically spaced over a length corresponding to the formation height, but with the vertically adjacent perforations being unaligned in a vertical direction.

The apparatus of this invention further incorporates a unique crossover flow control mandrel for a gravel packing apparatus which, in its run-in position, defines an unimpeded axial passage through the entire gravel packing apparatus. This permits a firing weight to be freely dropped through the gravel packing apparatus to fire the perforating gun disposed at the bottom end of the gravel packing apparatus.

During the run-in and perforating operation, a radial passage through the gravel packing mandrel, which provides communication from the interior of the bore of the mandrel through the annular fluid passage surrounding such bore into the annulus between the mandrel and the liner assembly, is closed by a sleeve which carries a ball valve seat at its upper end. The sleeve is retained in this position by a shear pin. Following the perforating operation, a ball is dropped onto the ball seat permitting fluid pressure within the work string to be increased sufficiently to set a fluid pressure operated packer. Further increase in pressure will cause a shearing of the shear pin and a downward movement of the ball seat sleeve to uncover the radial passage in the crossover mandrel assembly, thus restoring the fluid flow passages through the crossover mandrel to their normal configuration which permits the flow of gravel carrying fluid downwardly through the bore of the mandrel, thence outwardly through the uncovered radial passage into the annulus between the mandrel and the sleeve assembly, thence outwardly into the annulus between the liner assembly and the casing, and thence downwardly into the area between the screen and the casing perforations. The return fluid passes through the screen, thence into the annular passage surrounding the bore of the mandrel, and thence outwardly into the casing annulus through a radial port located above the packer, in conventional fashion.

Additionally, this invention provides a flapper valve below the ball valve which is normally held in an inoperative position relative to the continuous axial passage through the gravel packing apparatus until after the perforation of the well has been accomplished by the dropping of the firing weight, and the work string has been pressurized above the ball seat sleeve. Such flapper valve is held in its open position by a retaining sleeve and is spring biased to a closed position. The flapper valve is caused to move to its closed position after completion of the perforating operation by downward movement of the ball seat sleeve, and isolates the bore of the screen, hence the formation, from reverse fluid flow after the gravel packing is acomplished.

BRIEF DESCRIPTION OF THE DRAWINGS

FIGS. 7*b* and 7*c* respectively constituting vertical continuations of FIGS. 7*a* and 7*b*.

DESCRIPTION OF THE PREFERRED EMBODIMENTS

Figure 1A:
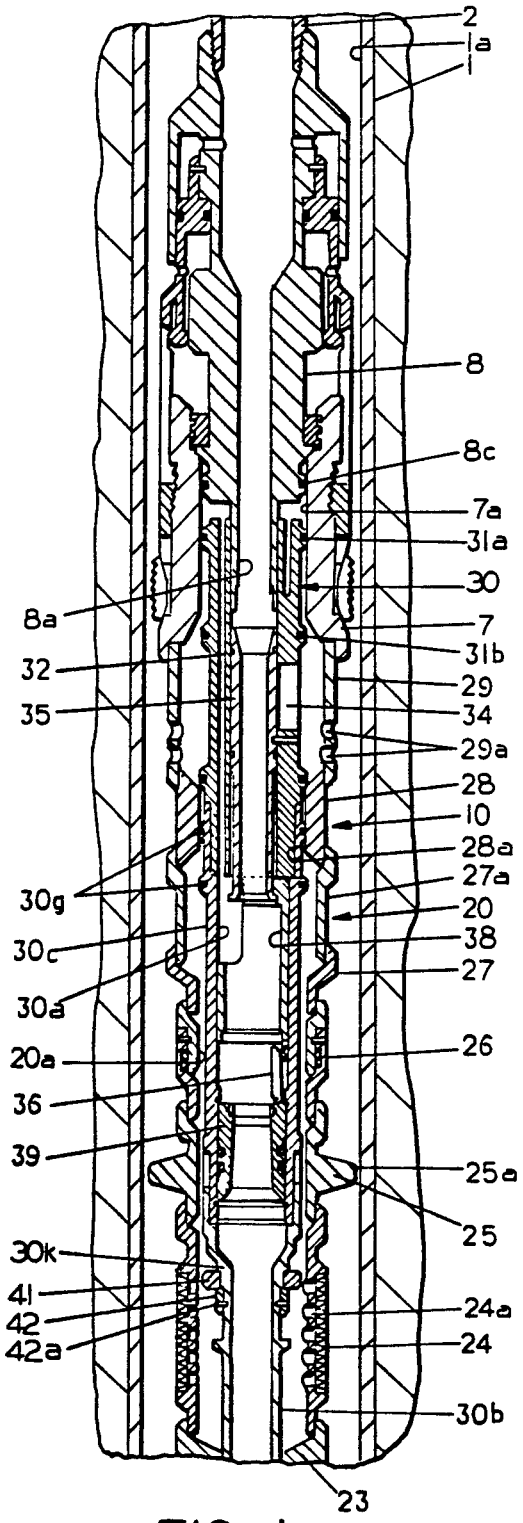
FIGS. 1*a* and 1*b* constitute a schematic vertical sectional view of a combined perforating and gravel packing apparatus incorporating this invention, shown with the components thereof in their run-in positions, FIG. 1*b* being a vertical continuation of FIG. 1*a*.
Figure 1B:
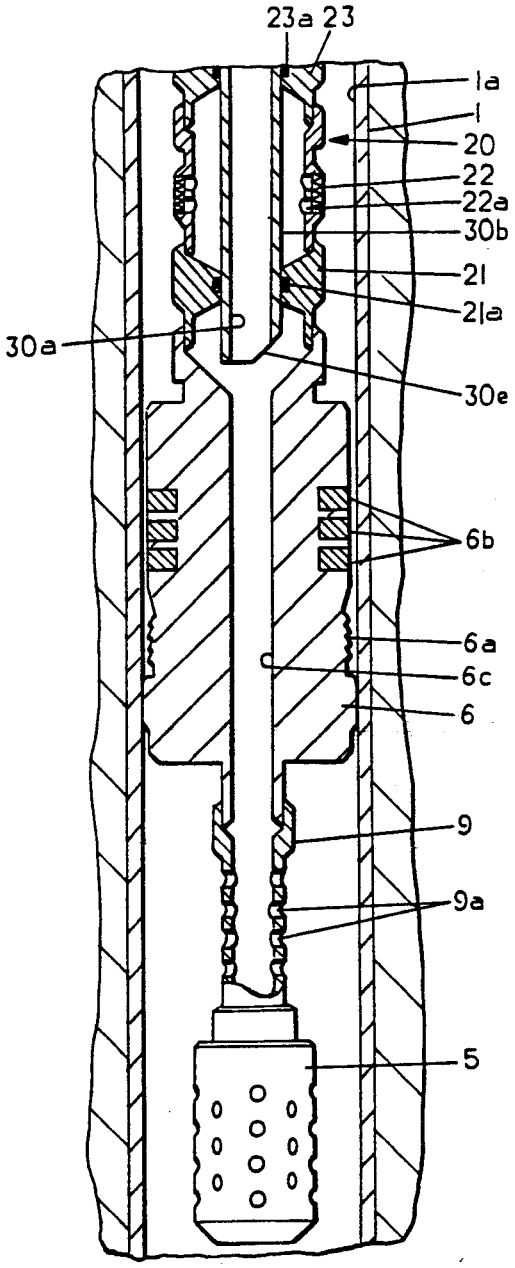

Referring now to FIGS. 1*a*-1*b*, there is shown a combined gravel packing and perforating apparatus 10 embodying this invention with all of the elements of the apparatus shown in their "run-in" position within the bore 1*a* of a well casing 1. Major components of the apparatus 10 include a percussion actuated perforating gun 5, which is supported in depending relationship from a first packer element 6 by a nipple 9 having radial wall perforations 9*a*. The packer element 6 is in turn suitably secured to the bottom end of a hollow liner assembly 20. On the top end of the liner assembly 20, a second packer 7 is conventionally secured. The packer 7 is of the type having a fluid pressure responsive actuator 8 which is detachably secured to the packer 7 and has its upper end secured to the end of a tubular work string 2. Depending from the actuator 8 is a hollow crossover mandrel 30. The axial bore 30*a* of the hollow crossover mandrel 30 extends entirely through the length of the assembly and is in direct communication with the bore 6*c* of the lower packer 6 and the bore of the nipple 9, hence providing direct communication with the percussion actuated perforating gun 5.

Figure 7A:
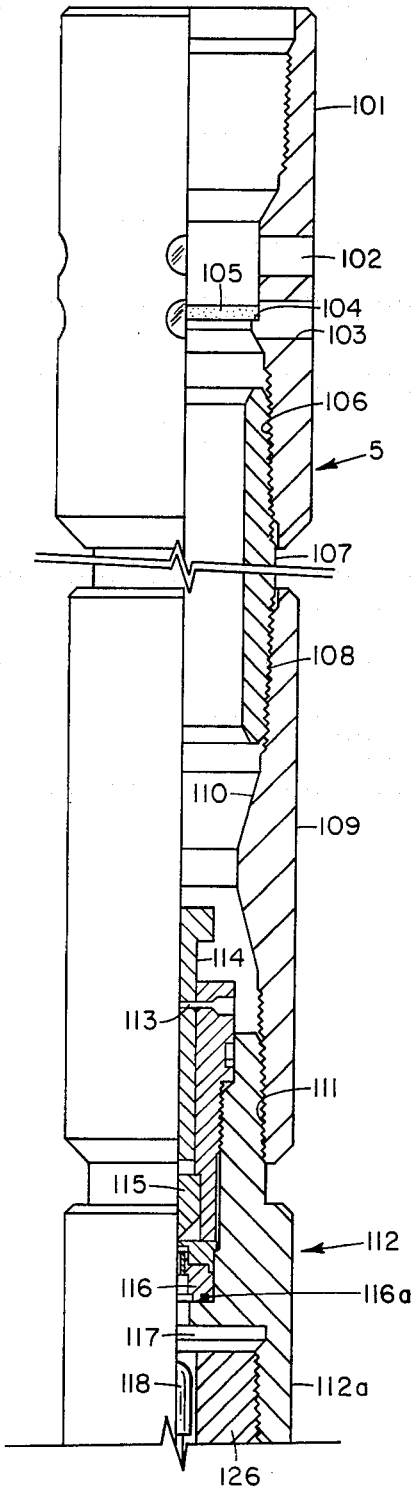
FIGS. 7*a*, 7*b* and 7*c* collectively constitute a vertical sectional view of a perforating gun which is preferred for use with the gravel packing apparatus of FIGS. 1*a* and 1*b*.
Figure 7B:
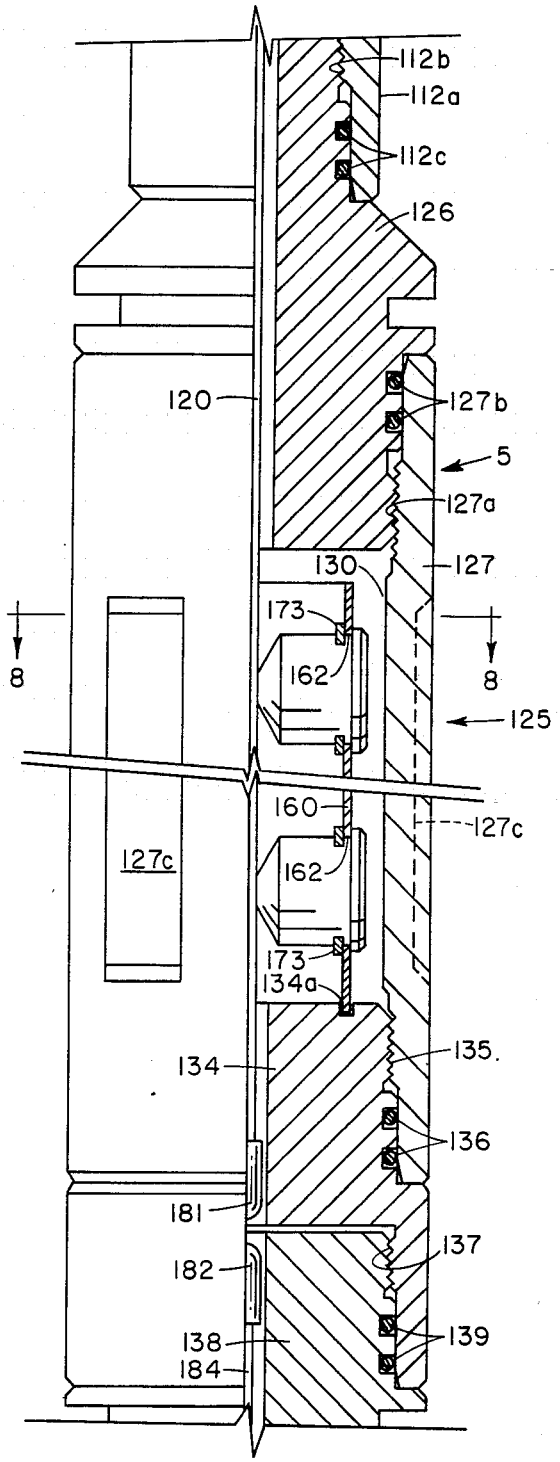
Figure 7C:
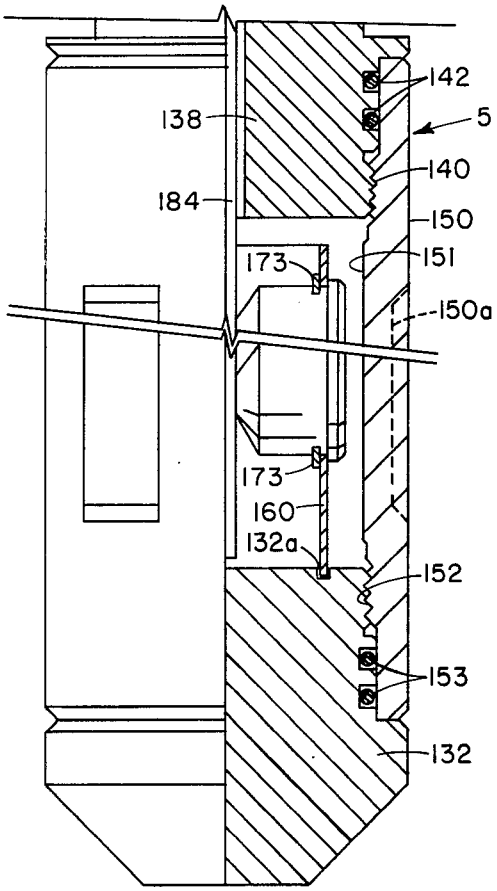

The perforating gun 5 may be any one of several well known types which contains explosive charges which are detonated to fire a plurality of radially directed charges through the walls of the casing 1, thus producing casing perforations 1*b* (FIG. 2) and associated perforations in the surrounding production zone of the well bore. A preferred gun structure is illustrated in FIGS. 7*a*, 7*b* and 7*c* and will be subsequently described. From the description thus far, it will be readily apparent that in the run-in position of the combined perforating and gravel packing apparatus, there is provided an unrestricted axial passage from the tubular work string 2 to the perforating gun 5, thus permitting a detonating weight or bar 5*a* (FIG. 2) to be dropped onto the gun 5 from the top of the well to effect its discharge and the production of perforations 1*b* in the well casing and the surrounding production zone.

All of the aforedescribed major components of the combined perforating and gravel packing apparatus 10 are assembled to the end of the tubular work string 2 at the well head and are lowered into the casing 1 by the work string 2 until the perforating gun 5 is positioned adjacent a desired production zone.

The lower packer 6 is of the type known in the art as a mechanically actuated, retrievable packer. In other words, through mechanical manipulation of the work string 2, the lower packer 6 may be expanded into sealing engagement with the interior bore 1*a* of casing 1 at any selected point. Further manipulation of the work string 2 will result in the collapsing of the lower packer 6 to permit it to be moved to another position. The packer 6 may, for example, comprise the Baker Model R-3 Single Grip Retrievable Casing Packer.

Figure 2:
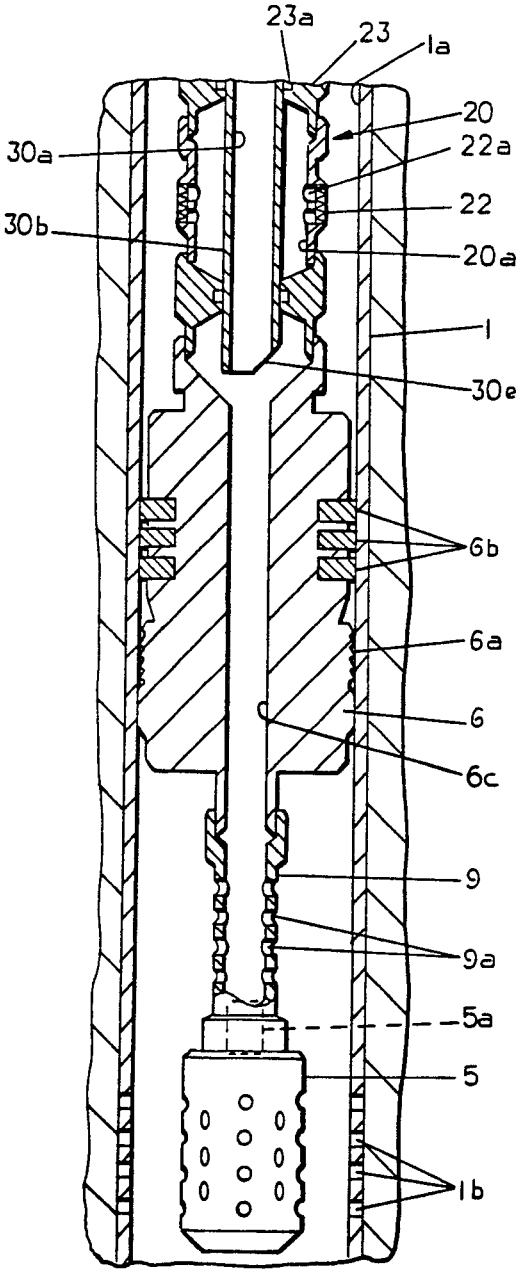
FIG. 2 is a view similar to FIG. 1*b* but showing the operation of the perforating gun.

Thus, the first step involved in the process after the run-in of the combined perforating and gravel packing apparatus 10 into the well casing is to effect the setting of the lower packer 6 by manipulation of the work string 2. This results in the expansion of gripping teeth 6*a* and annular seals 6*b* conventionally provided on the packer into engagement with the casing bore 1*a* (FIG. 2).

As previously mentioned, the top end of the lower packer 6 is conventionally secured, as by threads, to the bottom end of an elongated liner assembly 20. The liner assembly 20 is constructed in the same general manner as the liner assembly employed in the gravel packing apparatus described in the aforementioned U.S. Pat. No. 3,987,854. The construction of the liner assembly 20 will not, therefore, be described in great detail, but the principal elements thereof, starting at the bottom of the liner assembly (FIG. 1*b*) and moving upwardly, include the following items:

First is an O-ring seal sub 21 providing a mounting for an O-ring seal 21*a* which cooperates in sealing relationship with the lower tubular portion 30*b* of the crossover mandrel 30.

Next, the top end of the O-ring seal sub 21 is threadably secured to a conventional telltale screen 22 employed in the gravel packing apparatus. Screen 22 provides a plurality of radially disposed small area passages 22*a* communicating between the casing annulus and the interior of the hollow screen assembly 22. The passages 22*a* are sufficiently small in size to provide a barrier for the passage of the size of gravel particles with which the well is to be packed.

The top end of telltale screen 22 is in turn threadably secured to the bottom end of a second O-ring seal sub 23 which defines a support for an O-ring 23*a* which also sealingly engages the lower tubular portion 30*b* of the hollow crossover mandrel 30.

The top end of the second O-ring seal sub 23 is threadably engaged to the bottom of a main screen 24 around which the primary gravel pack is to be placed. The screen 24 may be of any one of several well known constructions and defines a plurality of radially disposed, restricted area fluid passages 24*a* which are sized to freely permit fluid flow therethrough from the casing annulus but prevent passage of the gravel particles of the size to be employed in the gravel packing operation.

The top end of the main screen 24 is threadably secured to the lower end of a blank pipe 25 which is provided with a radially projecting centering flange 25*a*. The top end of the blank pipe 25 is in turn threadably connected to the lower end of a conventional shearout safety joint 26 which permits release of component parts of the apparatus, including the upper packer 7, in the event that the apparatus becomes stuck in the well bore. The shearout safety joint 26 may be of conventional construction.

The top end of the shearout safety joint 26 is threadably secured to the lower end of a crossover sub 27. The top of crossover sub 27 is threadably secured to the bottom end of a blank pipe 27*a* which has its top end threadably secured to a seal bore unit 28 which defines an internal sealing surface 28*a* for cooperation with seals 30*g* provided on the enlarged upper end 30*c* of the hollow crossover mandrel 30. Lastly, the top end of seal bore unit 28 is threadably secured to a connecting sleeve 29 having radial passages 29*a* formed therein and its top end threadably secured to the lower end of the upper packer 7.

The upper packer 7 may be any one of several well known types which may be set by the fluid pressure operated actuator 8. For example, upper packer 7 may comprise Baker model "SC-1 Packer". Since the construction and operation of this type of actuator and packer is entirely conventional, it will not be further described. The actuator 8 is detachably secured to upper packer 7 in conventional fashion and threadably secured at its top end to the lower end of the tubular work string 2.

A hollow crossover mandrel 30 is suitably secured in depending relation to actuator 8 by engagement with a depending sleeve portion 8*a* of actuator 8. Starting from the top of the crossover mandrel 30, there is first provided a pair of axially spaced, annular seats for seals 31*a* and 31*b*. Seal 31*a* slidably and sealingly engages a seal bore surface 7*a* formed in the upper packer 7. The seal 31*b* provides sealing engagement with the bore 7*a* of the packer 7 when the crossover mandrel is raised relative to the packer by actuator 8 in a manner to be hereinafter described.

The mandrel assembly 30 also defines an annular fluid passage 32, open at its top end, which extends downwardly and has a semiannular lower end 32*a* (FIG. 4) communicating with the bore 30*a* extending through the upper portion 30*c* and the lower end 30*b* of the mandrel assembly 30.

Near the upper extremity of the enlarged upper portion 30*c* of the hollow crossover mandrel, a radial crossover port 34 is provided which permits fluid to pass from the axial bore 30*a* of the hollow mandrel to the exterior of the mandrel, passing through, but not communicating with the annular passage 32. Port 34 thus provides communication between the mandrel bore 30*a* and the annulus that exists between the exterior of the hollow crossover mandrel 30 and the interior bore 20*a* of the liner assembly 20.

Figure 4:
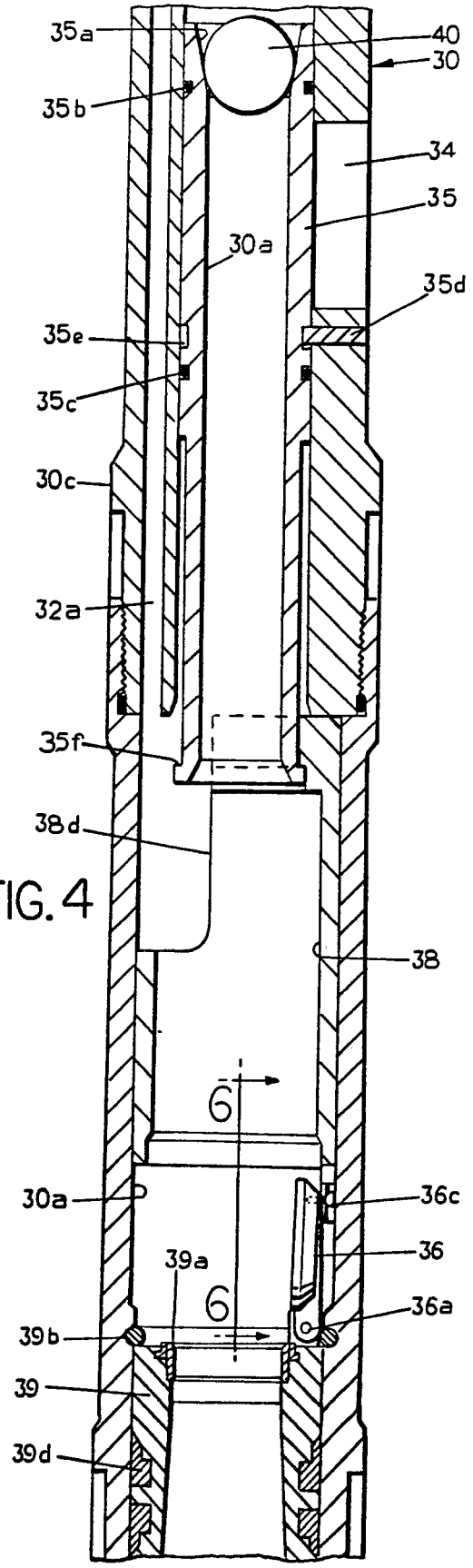
FIG. 4 is an enlarged scale vertical sectional view of a portion of the apparatus of FIG. 1*a*, illustrating in particular, the mounting of the flapper valve, with the valve shown in its open position.

In the run-in position of the hollow crossover mandrel, the crossover port 34 is closed by a sleeve 35 which defines at its upper end, an annular ball valve seat 35*a* (FIG. 4). Seals 35*b* and 35*c* on sleeve 35 respectively located above and below the crossover port 34 assure that such port will be sealed by sleeve 35 against any fluid flow from the bore 30*a* of the hollow crossover mandrel 30. The ball valve seat sleeve 35 is retained in the aforedescribed position with respect to the crossover port 34 by a shear pin 35*d* in the mandrel wall which engages a suitable annular groove 35*e* in the outer periphery of the sleeve 35.

Below the position of the ball valve seat sleeve 35, a flapper valve 36 is mounted for movement about a horizontal pin 36*a* from a vertical position, in which it does not significantly obstruct the bore 30*a* of the hollow crossover mandrel, to a horizontal position, shown in FIG. 5, wherein it cooperates with an upwardly facing, annular sealing surface 39*a* (FIG. 4) surrounding bore 30*a*. The flapper valve seat 39*a* is defined on the top portion of a second valve sealing sleeve 39 which is secured in a fixed position in the axial bore 30*a* of the hollow crossover mandrel 30 by a pair of C-rings 39*b* and 39*c* respectively engaging the top and bottom surfaces of the sleeve 39 and appropriate grooves formed in the bore 30*a*. Conventional sealing elements 39*d* are provided between the external surface of the sleeve 39 and bore 30*a* to prevent fluid leakage between the external surface of the valve seat 39*a* and the bore surface 30*a* of the hollow crossover mandrel 30. A torsion spring (not shown) is provided for flapper valve 36 to urge it towards its horizontal or closed position.

Figure 6:
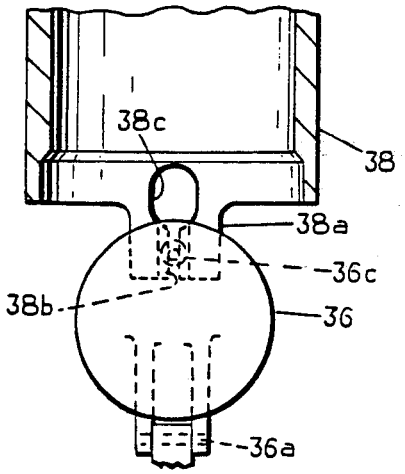
FIG. 6 is a sectional view taken on the plane 6—6 of FIG. 4.
Figure 5:
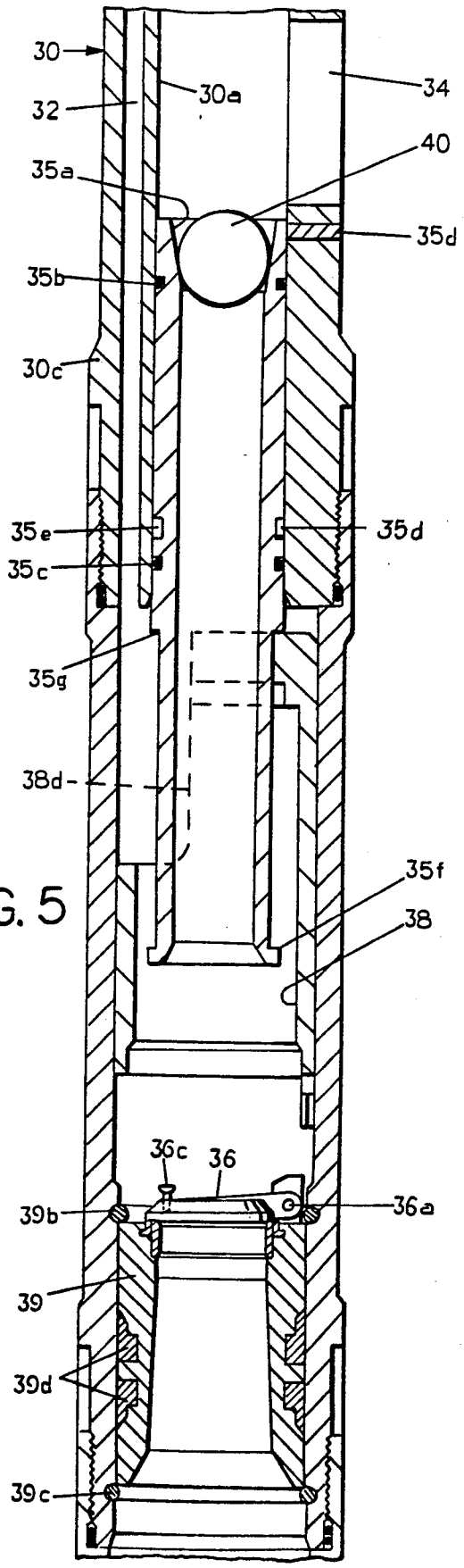
FIG. 5 is a view similar to FIG. 4 but showing the flapper valve in its closed position.

As it is best shown in the enlarged FIGS. 4–6, the flapper valve 36 includes a radially disposed, enlarged head, locking pin 36*c*. In the run-in position of the crossover mandrel 30, the shank portion of the enlarged head locking pin 36*c* is disposed within a narrow slot 38*b* defined by an axial projection 38*a* formed on the bottom end of a sleeve 38 which in turn is hung onto a radial flange 35*f* on the bottom end of the valve sleeve 35. The retaining slot 38*b* provided in the axial projection 38*a* of connecting sleeve 38 is enlarged at its upper end as shown at 38*c* so as to permit the headed locking pin 36*c* of flapper valve 36 to freely pass therethrough and permit the valve to assume its horizontal closed position in engagement with the valve seat 39*a* whenever the connecting sleeve 38 is moved axially downwardly by displacement of the valve seat sleeve 35 in a manner to be hereinafter described.

The connecting sleeve 38 is provided with a cutout portion 38*d* extending approximately half way around the upper portion of the sleeve to provide unimpeded communication between mandrel bore 30*a* and semi-annular passage 32*a*.

OPERATION

As previously mentioned, the entire apparatus which has heretofore been described, is run into the well casing 1 on the end of the tubular work string 2 and the perforating gun 5 is positioned opposite a region in the well casing where a production formation exists. With the perforating gun so located, the lower packer 6 is then set by manipulation of the tubular work string 2 (FIG. 2).

A detonating weight or bar 5*a* is then dropped through the tubular work string 2 and passes through the unimpeded axial bore 30*a* of the hollow crossover mandrel, bore 6*c* of lower packer 6, and nipple 9 and impacts on the top of the perforating gun 5, discharging the explosive charges contained therein and driving the charges carried by the gun outwardly to perforate the casing 1 and produce the perforations 1*b* as illustrated in FIG. 2.

Preferably prior to the firing of the perforating gun 5, the bore of the tubular work string 2 is filled with a light density fluid so that when the gun is fired, the work string will be in an "under balanced" condition; i.e., hydraulic fluid pressure at the face of the formation when the gun is fired will be less than the formation pressure, which insures that the formation pressure will force fluid into the well bore and upwardly to the surface. Such light fluid is introduced prior to the setting of the lower packer 6 and is pumped down through the tubular work string 2 displacing any heavier fluid existing in the work string, such as drilling mud, out of the bottom of the inserted apparatus through the perforated nipple 9 below the lower packer and returning to the surface through a bypass in the lower packer 6.

In most cases, it is desirable to permit fluid contained in the production formation to freely flow through the perforations 1*b* to effect a flushing of such perforations and the fissures in the formation. Such fluid flow enters the axial bore 30*a* of the hollow crossover mandrel assembly 30 through the perforations 9*a* provided in the connecting nipple 9 and flows freely up to the work string 2 and then to the top of the well.

After a sufficient flow period to insure the adequate flushing of the perforations, the well flow is closed in conventional fashion by the introduction of a heavy kill fluid downwardly through the tubular work string 2.

Figure 3A:
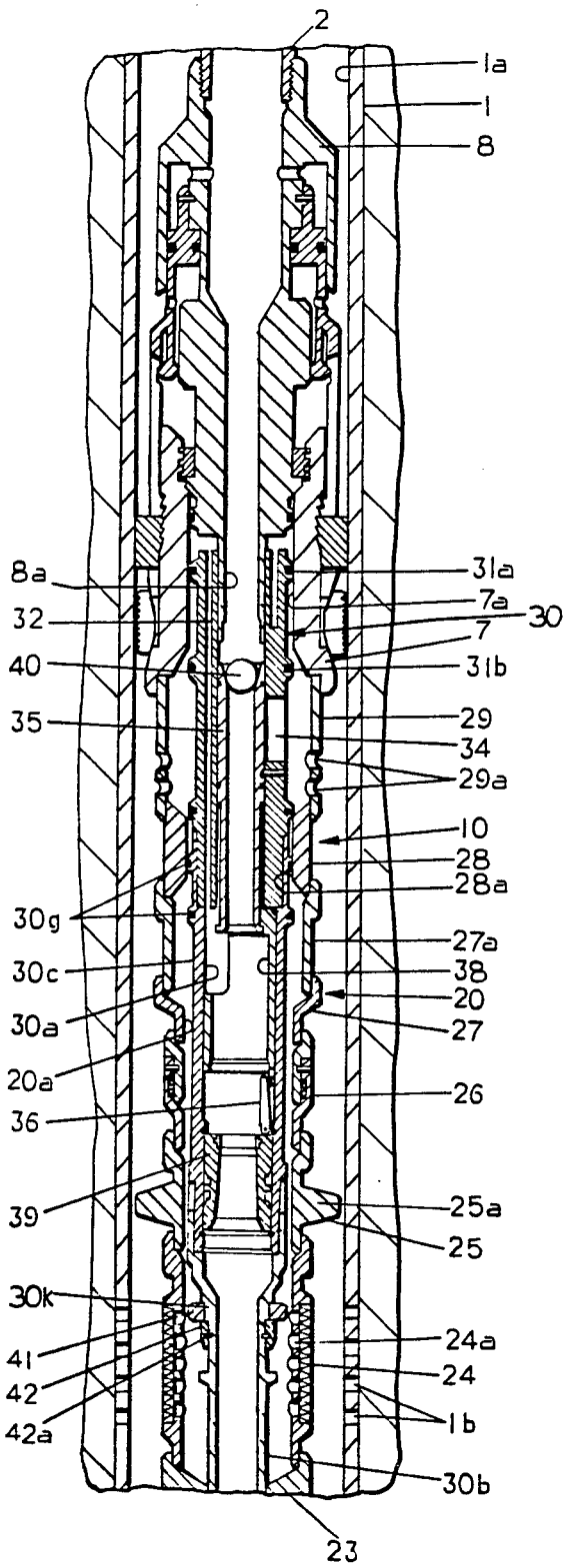
FIGS. 3*a* and 3*b* are views similar to FIGS. 1*a* and 1*b* but showing the position of the elements of the apparatus after the perforating operation and at the beginning of the gravel packing operation, FIG. 3*b* being a vertical continuation of FIG. 3*a*.
Figure 3B:
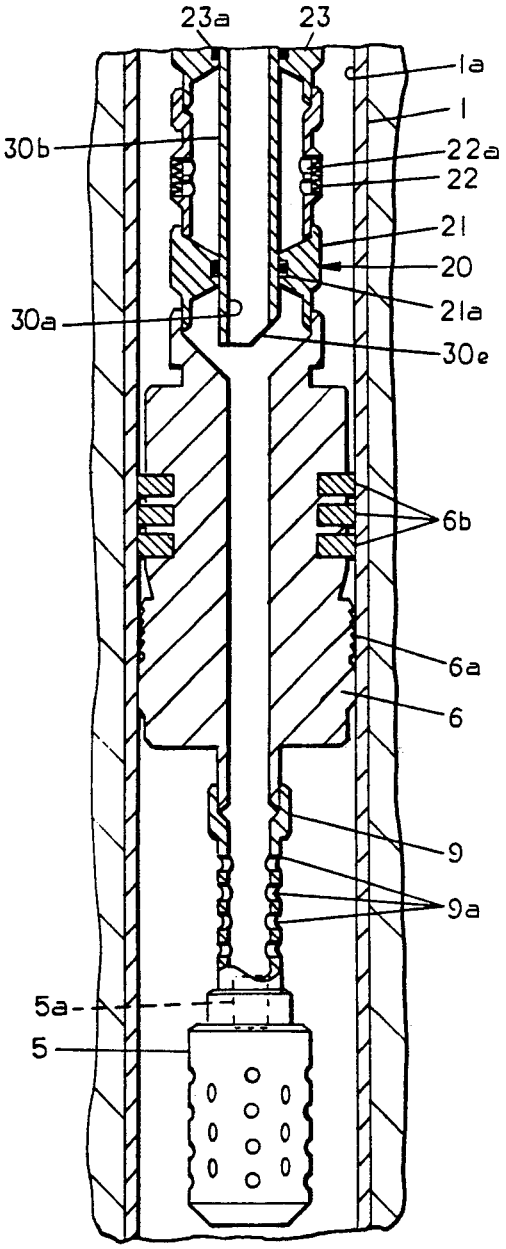

As soon as the well is under control by the kill fluid, the lower packer 6 is released by manipulation of the work string 2. The entire assembly is lowered down the well bore so that the main screen 24 is positioned opposite the newly produced perforations 1*b* (FIG. 3*a*). At this position, the lower packer 6 is then reset by manipulation of the tubular work string 2 (FIG. 3*b*). The lower packer now in essence becomes a sump packer and is generally permitted to remain in that position (FIG. 3*b*).

To initiate the gravel packing operations, the upper packer 7 is set through the application of fluid pressure through the tubular work string 2. To apply such fluid pressure, a ball 40 is dropped through the tubular work string and seats on the ball valve seating surface 35*a* defined by the valve seat sleeve 35. The fluid pressure within the work string and the upper portion of the hollow tubular mandrel assembly 30 may now be increased to a level which will effect the hydraulic operation of the actuator 8 which effects the setting of the upper packer 7 in conventional manner (FIG. 3*a*). After setting of the upper packer 7, the fluid pressure within the tubular work string 2 is then increased to an extent that a shearing of the shear pin 35*d* is accomplished and the ball valve seat sleeve 35 moves downwardly, thus uncovering the crossover port 34 in the crossover mandrel 30 (FIG. 5). Such downward movement is, of course, transmitted directly to the connecting sleeve 38 by a downwardly facing shoulder 35*g* which moves the enlarged portion 38*c* of the locking slot 38*b* into alignment with the locking pin 36*c* of the flapper valve 36 and permits the flapper valve 36 to shift to its horizontal, closed position as shown in FIG. 5, under the bias of the torsion spring. The actuator 8 is released from packer 7 and moved upwardly by work string 2 until an indicator ring 41 on the crossover mandrel 30 contacts the bottom of seal bore 28. The hollow mandrel assembly 30 is thus elevated to position its open bottom end 30*e* at a point above the lowermost O-ring seal sub 21 provided on the lower portion of the liner assembly 20.

As mentioned, the initial raised position of the hollow mandrel assembly 30 is determined by the engagement of the locating ring 41 which surrounds the lower, reduced diameter portion 30*k* of the enlarged upper portion 30*c* of the hollow mandrel assembly 30. Ring 41 is of C-shaped configuration and expanded to engage the bottom end of the seal bore 28. The ring 41 is releasably retained in its expanded position on the crossover mandrel 30 by a sleeve 42 which is slidable upon the lower cylindrical mandrel portion 30*b* and retained in its uppermost position by one or more shear pins 42*a*. Thus, when it is desired to raise the crossover mandrel 30 further by raising the work string 2, sufficient upward force is applied to the tubular work string 2 to effect the shearing of the shear pins 42*a* and this permits the positioning C-ring 41 to move downwardly over the smaller diameter mandrel portion 30*b* where it will contract so as to freely pass through the bore defined by the seal bore 28. The plurality of axially spaced seals 30*g* provided on the periphery of the upper enlarged mandrel portion 30*c* insures that at all times, one or the other of such seals is engaged with seal bore 28 as the vertical position of the hollow mandrel assembly 30 is shifted during the operation of the device for gravel packing.

The fluid pressure within the tubular work string may then be reduced and a gravel carrying fluid introduced into the gravel packing apparatus through the tubular work string 2. The flow path of such gravel carrying fluid through the gravel packing portion of the apparatus 10 is conventional, passing first into the axial bore 30*a* of the hollow mandrel assembly and then radially outwardly through the crossover port 34 into the annulus between the crossover mandrel 30 and the surrounding liner assembly 20. The fluid then flows through the ports 29*a* provided in the tubular element 29 into the annulus defined between the casing 1 and the outer periphery of the liner assembly 20. The gravel carrying fluid thus flows downwardly through the casing annulus to a position opposite the telltale screen 22. The gravel portion of the fluid will not pass the screen apertures 22*a* while the fluid passes inwardly to the internal bore 20*a* of the liner assembly.

The fluid then enters the bottom semi-annular portion 32*a* of the annular fluid passage 32 provided in the hollow crossover mandrel 30. It cannot flow directly upwardly through the axial bore 30*a* because such bore is blocked by the ball valve 40 which is subjected to the full downward pressure of the gravel carrying fluid to maintain a sealing engagement with the valve seat 35*a* provided on the valve seat sleeve 35. The fluid then flows through the top open end of the annular passage 32 and into the casing annulus at a point above the sealing surface 7*a* of the upper packer 7, because the actuator 8 has been shifted upwardly to position the top open end of annular passage 32 above the packer 7.

When the telltale screen 22 is fully covered with gravel, indicating that the gravel has reached the lowermost extremity of the region to be packed, the operator will detect a pressure increase.

Once the operator receives the pressure indication that the telltale screen 22 has been fully packed with gravel, the work string 2 may then be raised upwardly an additional distance, carrying the hollow crossover mandrel 30 with it, to, for example, position the open bottom end 30*e* of the hollow crossover mandrel assemblage at a position above the seal sub 23 in the liner 20. This then permits the gravel packing operation to continue, with the fluid flow being through the main screen 24, then upwardly through the annular passage 32, and then outwardly into the casing annulus at a point above the upper packer 7.

The packing operation is continued until the pressure build up indicates to the operator that the entire main screen 24 and the adjacent perforated area of the formation have been filled with gravel. At this point, there is generally excess gravel in the tubular work string 2 and after shearing the screws 42*a* by picking up on the work string 2, a reverse fluid flow is applied to the work string 2 to remove the excess gravel. Such reverse flow is, of course, accomplished in conventional fashion by pressurizing the casing annulus and flowing the fluid through the crossover port 34 into the bore 30*a* of the hollow crossover mandrel 30 and then upwardly through the tubular work string 2. It is during this operation that the flapper valve 36 performs its primary function in that it prevents the reversing fluid from entering the fluid bypass system that goes around the crossover port 34, and going down through the bore 30*a* of the crossover mandrel 30 to the formation.

Following completion of the removal of the excess gravel, the setting tool or actuator 8, with the hollow crossover mandrel 30 connected thereto, is removed from the well and the well is ready for subsequent testing or production operations.

Referring now to FIGS. 7*a*, 7*b* and 7*c*, there is illustrated a preferred form of perforating gun 5 for employment with the gravel packing apparatus heretofore described. The gun 5 comprises a ported sub 101 which is substituted for the ported conduit 9 and achieves the threaded connection of the perforating gun to the bottom end of the lower packer 6. Sub 101 includes a plurality of peripherally spaced radial ports 102 and 103. Port 103 is located in the immediate vicinity of an upwardly facing shoulder 104 on which a frangible disc 105 is seated. Disc 105 provides protection for the detonating components of the perforating gun against inadvertent activation by debris falling through the well. Frangible disc 105 is preferably formed from a sheet of glass having sufficient strength to require the dropping of a detonating weight to achieve its breakage. The ports 102 and 103 permit the flushing of the upper surface of the frangible disc 105 by fluid introduced through the work string to remove debris therefrom through such ports.

The lower end of ported sub 101 is provided with internal threads 106 which are engaged with the top end of a pup joint 107 having a lower threaded portion 108 threadably engaged with a guide sleeve 109. Guide sleeve 109 is provided with an inwardly sloped surface 110 which functions to direct any detonating weight dropped toward the center of the bore of the guide sleeve 109.

The lower end of guide sleeve 109 is secured by threads 111 to a firing head 112. Firing head 112 is of conventional configuration, having an upwardly projecting hammer 114 secured in elevated position relative to a firing pin 115 by a shear pin 113. Firing pin 115 in turn is positioned immediately above a detonating cartridge 116 which is in communication with an enlarged chamber 117 and a booster charge 118 disposed in the upper end of a tubular housing hanger 126. The cartridge 116 contains a face seal 116*a* to isolate well fluids from the interior of the gun. The detonating cartridge is in communication with two small diameter passages which lead to a booster charge 118. The booster charge 118 comprises any conventional form of blasting cap, such as the C63 booster, manufactured by DuPont.

The lower end 112*a* of the firing head 112 is sealably secured to the top end of a tubular housing assemblage 125 by threads 112*b* and O-rings 112*c* (FIG. 7*b*). Tubular housing assembly 125 comprises the annular hanger 126, and a chamber defining sleeve 127. Chamber defining sleeve 127 is secured to the lower end of hanger 126 by threads 127*a* and O-rings 127*b* seal the threaded connection. The sleeve 127 defines a vertical axis cylindrical chamber 130. The lower end of the chamber 130 is sealed either by a bull plug 132 (FIG. 7*c*) or by a connector sub 134 having external threads 135 engaging the bottom end of sleeve 127 and a pair of O-rings 136 seal the threaded connection. The connector sub 134 is employed if it is desired to provide an additional chamber for the mounting of additional shaped charges in the manner that will be hereinafter described. Connector sub 134 is provided at its lower end with internal threads 137 which engage a connector nipple 138. O-ring seals 139 effect the sealing of this threaded joint. Nipple 138 is provided at its bottom end with external threads 140 for supporting a second chamber defining sleeve 150 (FIG. 7*c*). O-ring seals 142 effect the sealing of the threads 140.

The second chamber defining sleeve 150 defines a second vertical axis cylindrical chamber 151 and in turn is connected at its bottom end to either another connector box, if additional chambers are required, or to the bull plug 132 by threads 152 and O-rings 153.

In accordance with this invention, the mounting of a plurality of perforating charges within the vertical axis cylindrical chambers 130 and 151 is accomplished most conveniently through the utilization of a supporting strip or carrier 160 having a polygonal configuration. For reasons to be hereinafter developed, the polygonal configuration includes an even number of sides and a minimum of six sides. In other words, the carrier 160 has a polygonal cross section including N sides where N is an even number not less than six.

Figure 9:
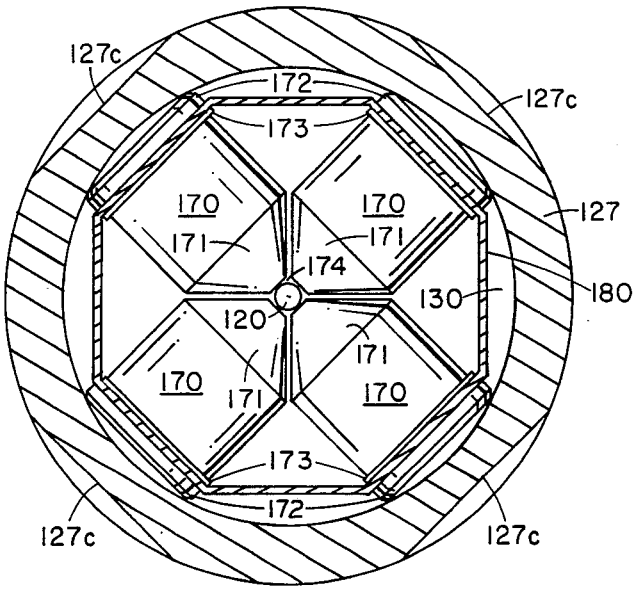
FIG. 9 is a view similar to FIG. 8 but illustrating the utilization of a polygonal carrier having eight sides.
Figure 8:
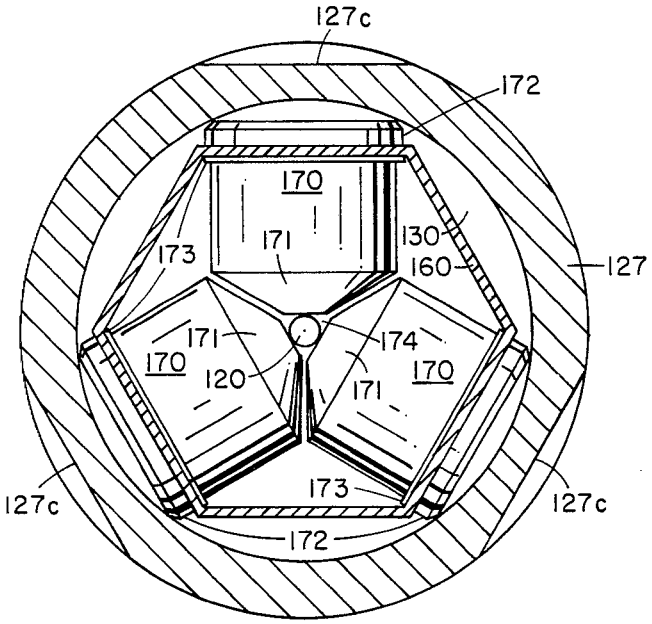
FIG. 8 is a sectional view taken on the plane 8—8 of FIG. 7*b*.

The reason for this specific configuration may be readily appreciated by reference to the cross sectional views of FIGS. 8 and 9 wherein the arrangement of the shaped charge containers 170 is indicated for a six sided carrier 160, in the case of FIG. 8, and an eight sided carrier 180, in the case of FIG. 9. The shaped charge containers 170 are of generally cylindrical configuration but are provided with an enlarged flange 172 at their outer ends. Flanges 172 abut the planar outer faces of polygonal carrier 160 and maintain the exact radial orientation of the spaced charges when discharged. A snap ring or clip 173 secures each container 170 to carrier 160. The inner container ends 171 are conically shaped with the angle of the cone determined by the number of shaped charge containers that are to be disposed in any one horizontal group. This permits the inner ends 171 to lie closely adjacent and define an axial opening 174 for reception of a primer cord 120 which is connected to booster charge 118. The internal construction of the shaped charge (not shown) is conventional.

Figure 10:
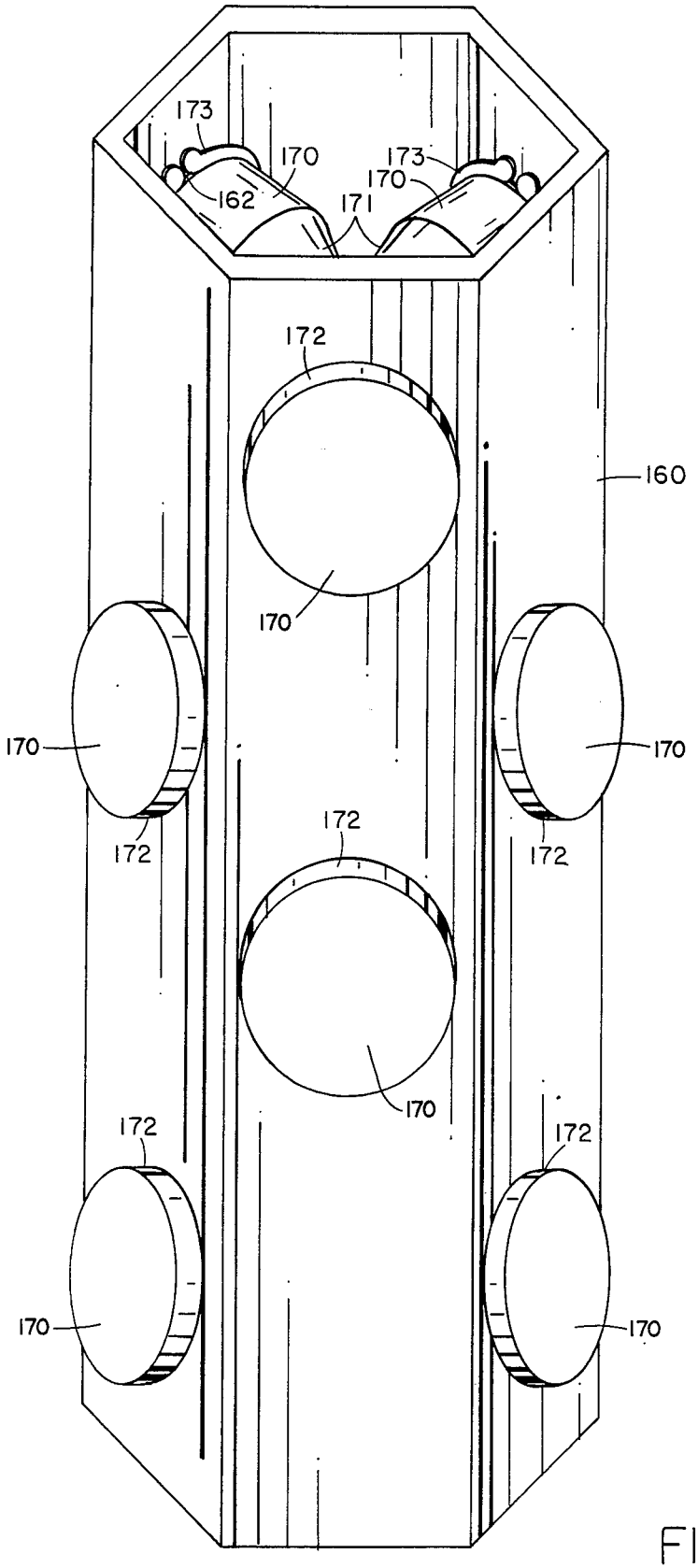
FIG. 10 is a perspective view of a polygonal carrier with shaped charge containers assembled thereto.

The reason for employing a polygonal carrier of not less than six sides is the fact that it is not desirable to vertically align the vertically adjacent perforations. The most desirable arrangement of perforations is a plurality of vertically spaced, horizontal groups with the perforations in each horizontal group being angularly displaced from the perforations in the next adjacent horizontal group. Thus, the polygonal carrier 160 is provided with a plurality of vertically spaced apertures 162 (FIG. 10) for respectively receiving the shaped charge containers 170 therein. However, as best shown in the perspective view of FIG. 10, the first horizontal group of shaped charge containers 170 is not axially aligned with the second row of charge containers 170 but is angularly displaced therefrom by 60° or 360°/N where N equals six sides. Likewise, the second horizontal group of charge containers 170 is angularly displaced from the third row of charge containers 170, etc. Thus, the polygonal sides of the carrier 160 are apertured so as to produce a plurality of vertically spaced horizontal arrays of shaped charge containers 170, with the containers in each horizontal array being angularly displaced from the containers in the next vertically adjacent horizontal array by an angle equal to 360°/N, where N is the number of polygonal sides.

The reason for utilizing a polygon having an even number of sides is to permit the shaped charge containers mounted thereon to be equally peripherally spaced. This is readily apparent from FIG. 8 in the case of a six sided carrier, and in the case of an eight sided carrier from FIG. 9. If a five or seven sided carrier were employed, the resulting perforations would not be equally angularly spaced around the periphery of the well casing. Moreover, it is desirable that at least a six sided polygonal carrier be employed due to the fact that it is recognized that a four-sided strip would only result in two diametrically opposed perforations being produced, which is not adequate for the majority of producing wells.

As a practical matter, a six-sided polygonal carrier is preferred for the majority of wells. For large well casings, there is sufficient room to adequately mount additional shaped charge containers in each horizontal array and hence an eight-sided carrier or one with a higher number of sides could be effectively employed.

To minimize the manufacturing cost of the polygonal carrier 160 and ensure its dimensional accuracy, it is preferred to manufacture such carrier by extrusion of an extrudable metal such as aluminum. This then permits the field operation to be stocked with several lengths of six-sided aluminum strips, such as three foot, seven foot and even up to fourteen foot lengths, and corresponding lengths of chamber sleeves 127, and the proper length strip can be selected to permit all of the shaped charge containers to be disposed within a single vertical axis sealed chamber 130 provided by the selected length of chamber sleeve 127. On the other hand, if the height of the producing formation is in excess of fourteen feet, then two or more charge receiving chambers may be fabricated in the field through utilization of the connector sub 134 and the connector nipple 138 and two or more chamber sleeves, and the required lengths of polygonal carrier strips 160 can be inserted in the resulting chambers.

As mentioned, the shaped charge containers in chamber 130 have their inner ends each abutting primer cord 120 which extends downwardly from the booster charge 118 contained in the firing head 112. Such primer cord is entirely conventional and may, for example, comprise the flexible cord-type explosive sold under the trademark "Primacord" by the Ensign-Bickford Company of Simsbury, Conn. Usually it is a hollow fabric or plastic tube filled with a well known detonable explosive, such as pentaerythritoltetranitrate, which may be fired by applying a detonating shock at any point along its length, or on its ends, and, in the construction heretofore described, the detonating shock is applied by the booster charge 118. When additional charge containing chambers are connected to the perforating gun mechansim by the connector sub 134 and nipple 138, the primer cord 120 terminates in another booster 181 which is disposed in connector box 134 axially adjacent to a third booster 182 disposed in nipple 138. Booster 182 is connected to a primer cord 184 which extends downwardly through the central aperture in the connector nipple 138 and thence into the next chamber 151 to effect the detonation of the shaped charges contained in such chamber.

To permit the central symmetric positioning of the polygonal carriers 160 in the chambers 130 or 151, the member forming the bottom wall of such chamber may be provided with a polygonal groove to receive the bottom end of polygonal carrier 160. Thus, the connector sub 134 is provided with groove **134*a* and the bull plug 132 with groove 132*a*. Alternatively, lock in screws or keys and grooves may be used for the same purpose. With the carrier 160 thus oriented, the chamber defining sleeves 127 and 150 may have reduced wall sections 127*c* and 150*a* formed therein as shown in the drawings, or by use of flat bottom holes or the like, opposite the known locations of the shaped charge containers 170** to reduce the energy required to blast through such sleeves.

While the invention has been described in terms of a specific application of the unique perforating gun and crossover mandrel construction to accomplish the perforating of a well and gravel packing the perforated area in a single trip of the apparatus into the well, those skilled in the art will recognize that any operation below the gravel packing area requiring the axial passage of a tool or instrument through the unrestricted axial bore of the hollow crossover mandrel assembly embodying this invention, could also be accomplished. Thus, testing operations in a perforated well could be accomplished below the gravel packing apparatus with a single trip of the entire apparatus into the well.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. The method of field assembly of a selected number of shaped charges in a well casing perforating gun, comprising the steps of:

(1) selecting an extruded polygonal carrier strip having N faces where N is an even number greater than 4 and N/2 equals the desired number of perforations at any horizontal level;

(2) forming shaped charge container mounting holes in vertically spaced relation in each planar side of the polygonal carrier with each horizontally aligned group of mounting holes being angularly spaced from the vertically adjacent horizontal group of mounting holes by 360°/N;

(3) inserting shaped charge containers in the mounting holes;

(4) inserting the polygonal carrier and shaped charge containers in a tubular housing connectable to a work string.

2. The method of field assembly of a selected number of shaped charges in a well perforating gun, comprising the steps of;

(1) selecting an extruded tubular polygonal carrier strip having N faces where N is an even number greater than 4 and where N/2 equals the desired number of perforations at any horizontal level;

(2) forming shaped charge container mounting holes in vertically spaced relation in each planar side of the polygonal carrier with each horizontally aligned group of mounting holes being angularly spaced from the vertically adjacent horizontal group of mounting holes by 360°/N;

(3) inserting shaped charge containers in the mounting holes with peripheral flanges on the outer ends of the containers being respectively abuttable with the outer faces of the polygonal carrier and the inner ends of the containers defining a central passage;

(4) inserting a primer cord in the central passage;

(5) inserting the polygonal carrier in a tubular housing connectable to a work string; and (6) closing the upper end of the tubular housing with an impact actuated detonator disposed adjacent a portion of the primer cord.

* * * * *